US012075878B2

(12) United States Patent
Truelsen et al.

(10) Patent No.: US 12,075,878 B2
(45) **Date of Patent: *Sep. 3, 2024**

(54) ARTICLE OF FOOTWEAR

(71) Applicant: ECCO SKO A/S, Bredebro (DK)

(72) Inventors: Ejnar Truelsen, Bredebro (DK); Frank Jensen, Bredebro (DK)

(73) Assignee: ECCO Sko A/S, Bredebro (DK)

( * ) Notice: Subject to any disclaimer, the term of this patent is extended or adjusted under 35 U.S.C. 154(b) by 224 days.

This patent is subject to a terminal disclaimer.

(21) Appl. No.: 17/127,371

(22) Filed: Dec. 18, 2020

(65) Prior Publication Data

US 2021/0186150 A1 Jun. 24, 2021

(30) Foreign Application Priority Data

Dec. 20, 2019 (EP) ..... 19218828

(51) Int. Cl.

| | |
|---|---|
| ***A43B 7/14*** | (2022.01) |
| ***A43B 13/04*** | (2006.01) |
| ***A43B 13/12*** | (2006.01) |
| ***A43B 13/14*** | (2006.01) |
| ***A43B 13/18*** | (2006.01) |

(52) U.S. Cl.

CPC ..... *A43B 13/14* (2013.01); *A43B 7/1495* (2013.01); *A43B 13/125* (2013.01); *A43B 13/184* (2013.01)

(58) Field of Classification Search

None

See application file for complete search history.

(56) References Cited

U.S. PATENT DOCUMENTS

| | | | | |
|---|---|---|---|---|
| 5,940,990 | A * | 8/1999 | Barret | A43B 5/002 36/55 |
| 6,401,366 | B2 * | 6/2002 | Foxen | A43B 7/1495 36/102 |
| 6,701,643 | B2 * | 3/2004 | Geer | A43B 17/08 36/97 |
| 7,444,767 | B2 | 11/2008 | Kilgore et al. | |

(Continued)

FOREIGN PATENT DOCUMENTS

| | | |
|---|---|---|
| CN | 101959435 | 1/2011 |
| CN | 106539186 | 3/2017 |
| GB | 2258801 A | 2/1993 |

OTHER PUBLICATIONS

European Search Report dated Jun. 2, 2020 from the European Patent Office in EP Application No. 19218828.2.

(Continued)

*Primary Examiner* — Jila M Mohandesi

(74) *Attorney, Agent, or Firm* — Lee & Hayes, P.C.

(57) ABSTRACT

An article of footwear comprising: an upper having an outer surface, a foot insertion volume and a sole facing surface; and a sole assembly comprising: a midsole having a foot facing surface, a ground facing surface, a heel region, forefoot region and an arch region between the heel region and the forefoot region in a longitudinal direction, a medial reinforcement member positioned at a medial side of the midsole and/or a lateral reinforcement member positioned at a lateral side of the midsole, where the medial and/or the lateral reinforcement member is/are configured to increase the rigidity of the midsole in a longitudinal direction in the arch region.

20 Claims, 4 Drawing Sheets

(56) References Cited

U.S. PATENT DOCUMENTS

| | | | | |
|---|---|---|---|---|
| 8,474,153 | B2 * | 7/2013 | Brie | A43B 3/18 36/103 |
| 2006/0277798 | A1 * | 12/2006 | Reilly | A43B 7/143 36/108 |
| 2012/0124865 | A1 * | 5/2012 | Opie | A43B 5/18 36/73 |
| 2014/0245700 | A1 * | 9/2014 | Bushby | A43B 7/226 83/13 |
| 2014/0259789 | A1 | 9/2014 | Dojan et al. | |
| 2014/0325876 | A1 | 11/2014 | Dodge | |
| 2015/0013185 | A1 | 1/2015 | Elder | |
| 2016/0324254 | A1 | 11/2016 | McDonald | |
| 2017/0360141 | A1 * | 12/2017 | Azoulay | A43B 11/00 |
| 2018/0064200 | A1 * | 3/2018 | Apostolopoulos | A43B 5/18 |
| 2019/0200700 | A1 | 7/2019 | Hale | |

OTHER PUBLICATIONS

Chinese Search Report for Chinese Patent Application No. 2020115083816 dated Dec. 14, 2023, 2 pages.
EPO Communication for corresponding EP Patent Application No. 19218810.0 dated Apr. 23, 2024, 5 pages.
EPO Communication for corresponding EP Patent Application No. 19218828.2 dated Apr. 23, 2024, 5 pages.

* cited by examiner

ARTICLE OF FOOTWEAR

This application claims priority to European Patent Application No. 19218828.2, filed on Dec. 20, 2019, the disclosure of which is incorporated herein by reference in its entirety.

TECHNICAL FIELD

An article of footwear comprising: an upper having an outer surface, a foot insertion volume and a sole facing surface; and a sole assembly comprising: a midsole having a foot facing surface, a ground facing surface, a heel region, forefoot region and an arch region between the heel region and the forefoot region in a longitudinal direction,

BACKGROUND

Articles of footwear are designed and manufactured in a plurality of ways, where an article of footwear which has a specific application may have constructional features that are advantageous for the specific application. This means that articles of footwear that are designed for hiking may have a significantly different structure than articles of footwear that are designed for running. The structures may be in the form of a specific type of midsole, a specific type of upper, specific type of outsole, etc.

In traditional footwear manufacturing articles of footwear may be provided with a shank, where the shank is embedded inside the sole assembly of the shoe, where the shank may be utilized to provide support in the arch region or to provide increased rigidity between the heel region and the arch region of the shoe, so that the forefoot region of the article of footwear is flexible, and may be flexed when the user sets off in gait.

However, a shank is traditionally a rigid element which is inserted into an area of the sole assembly where it may be important to have shock absorption. The introduction of a rigid shank into this area may mean that the midsole of the shoe may have to be compensated for the shank by e.g. increasing the thickness of the sole or reducing the material hardness. These compensations may be seen as detrimental to the construction of the sole assembly, which traditionally have been attempted to solve by a specific design of embedded shanks having specific designs that overcome the detrimental effect of the rigidity of the shank. However, the further design of the shanks means that the effect of the shank has to be addressed when designing the sole assembly.

Thus, there is a need to improve the way a rigidity may be applied to a sole assembly.

GENERAL DESCRIPTION

In accordance with the present description, there is provided an article of footwear comprising: an upper having an outer surface, a foot insertion volume and a sole facing surface; and a sole assembly comprising: a midsole having a foot facing surface, a ground facing surface, a heel region, forefoot region and an arch region between the heel region and the forefoot region in a longitudinal direction, a medial reinforcement member positioned at a medial side of the midsole and/or a lateral reinforcement member positioned at a lateral side of the midsole, where the medial and/or the lateral reinforcement member is/are configured to increase the rigidity of the midsole in a longitudinal direction in the arch region.

Within the understanding of the present disclosure the term rigidity in relation to the support element and the reinforcement member may be understood as rigidness relative to bending force. I.e. the rigidity relates to how easy or hard it is to bend the support element and/or the reinforcement member.

Within the understanding of the present invention, a sole assembly may be seen as having a longitudinal axis, which extends from the heel end of the sole assembly to the toe end of the sole assembly, and extends along the length of the sole assembly. The sole assembly may be divided into separate regions such as the forefoot region, the heel region and an arch region, where each of these regions of the sole assembly may have different functionalities. The regions of the sole assembly may correspond to areas of the foot of the user, so that e.g. the arch region is positioned in the arch region of the foot of the user. The arch region may e.g. function as a part of the midsole that provides support to the arch of the foot, while the heel region may e.g. function as a shock absorber during a heel strike during human gait, while the forefoot area may e.g. provide flexibility for the user to set off. Thus, each region of the sole assembly in the longitudinal direction may have a different function, which may mean that a sole assembly may have different parts having different attributes, and that the regions may be seen in different parts of the sole assembly in a longitudinal direction.

The forefoot region of the sole assembly may be separated from the arch region via a first separation axis, where the first separation axis defines a region between the forefoot region and the arch region. The first separation axis may be seen as an axis that may define a region which defines a boundary between the mechanic attributes of the forefoot region of the sole assembly and the mechanic attributes of the arch region of the sole assembly and/or the heel region of the sole assembly. Thus, as an example the first separation axis may e.g. define a region of the sole assembly where the sole assembly, in a direction from the heel are to the forefoot area, where the sole assembly may transition from a stiff sole assembly to a flexible sole assembly.

The heel region of the sole assembly may be separated from the arch region via a second separation axis, where the first separation axis defines an region between the heel region and the arch region. The second separation axis may be seen as an axis that may define a region which defines a boundary between the mechanic attributes of the heel region of the sole assembly and the mechanic attributes of the arch region of the sole assembly and/or the forefoot region of the sole assembly. Thus, as an example the second separation axis may e.g. define a region of the sole assembly where the sole assembly, in a direction from the heel are to the forefoot area, where the sole assembly may transition from a shock absorbing to a more supportive and/or flexible sole assembly, where the shock absorption is reduced compared to the heel assembly. In one or more examples the transition between the heel region and the arch region may be stiff, i.e. that the bending force in the heel region abutting the second separation axis and the bending force in the arch region abutting the second separation axis is similar and/or equal.

Within the understanding of the present disclosure the bending force may be seen as the amount of energy it takes to compromise an item from its natural shape. The bending force of the sole assembly may be seen as the force needed to bend the sole assembly from its natural position along the longitudinal axis of the sole assembly. The bending force of the support element and/or the reinforcement member may be seen as the force needed to bend the reinforcement member and/or the support element in a radial direction, i.e. from a central axis of the footwear and in a direction outwards and/or inwards. Alternatively the bending force of the reinforcement member and/or the support element may be in a direction parallel to the longitudinal axis of the sole assembly.

In one or more exemplary embodiments, the first and/or the second separation axis may be in the form of a straight line extending from a medial part of the sole assembly to a lateral part of the sole assembly or may alternatively be a polygonal line extending from a medial part of the sole assembly to a lateral part of the sole assembly.

The provision of a sole assembly in accordance with the present disclosure, it may be possible to provide a sole that has optimal shock absorption while still having a high rigidity in the longitudinal direction in the arch region. The reinforcement member may be utilized to support the midsole from the side, so that a soft material of the midsole will maintain its shape even though a force is applied during use. Thus, the reinforcement element may e.g. be utilized to increase the stiffness of the sole assembly in the arch region, to ensure that the sole assembly has a reduced ability to flex in the longitudinal direction when the user is wearing the shoe.

The reinforcement member may increase the stiffness of the midsole and/or sole assembly in a longitudinal direction, i.e. in a direction that extends from the heel end towards the toe end of the sole assembly. The reinforcement member may reduce the bendability of the midsole in such a manner that it will require an increased force to bend the midsole in the longitudinal region where the reinforcement member is present. This means that if the reinforcement member would not be added to the side of the midsole, the midsole would flex and/or bend at a lower force than when the reinforcement member is attached. This means that the reinforcement member may be utilized to increase the stiffness of the midsole, without compromising the shock absorption of the midsole. This may also mean that a midsole of the sole assembly may be provided without an embedded shank.

The reinforcement member may be positioned on the side of the midsole, where the reinforcement member is connected to a side of the midsole in such a manner that the rigidity of the reinforcement member is transferred to at least part the material of the midsole. An inner surface of the reinforcement member may be connected to an outer surface of the midsole, where the connection may transfer the rigidity of the reinforcement member to the midsole.

By providing a medial and a lateral reinforcement member the midsole may be supported on both sides, where the increase in rigidity on both lateral sides of the arch region may ensure that the rigidity of the sole assembly may be higher than the midsole on its own. The medial and lateral reinforcement members may provide a sole assembly having a peripheral part in the arch region which has a higher stiffness than a central area of the sole assembly. I.e. where the central area is positioned between the medial and lateral reinforcement members.

The reinforcement member may be utilized to provide an increased support in the arch region, where the reinforcement member may ensure that the arch region of the sole of the foot is supported during use of the article of footwear. In a situation where the midsole of the sole assembly is a material of low rigidity, the reinforcement member may provide increased rigidity in the arch region, ensuring that the arch of the foot will be supported by the reinforcement member and the midsole due to increase in rigidity in the arch region.

In one exemplary embodiment, the medial and/or lateral reinforcement member may extend in a longitudinal direction from a region facing the heel region of the midsole and/or article of footwear towards a region facing a boundary of a forefoot region of the midsole and/or article of footwear. Thus, the reinforcement member may extend continuously and/or unbroken along the arch region of the midsole. The reinforcement member will thereby increase the rigidity of the midsole in a longitudinal direction in the arch region, where the reinforcement member may reduce the risk that the midsole will bend in the arch region in the longitudinal direction, and/or may provide increased support to the arch of the foot during use.

In one exemplary embodiment the reinforcement member and/or any reinforcement member may be absent from the forefoot region of the midsole, and thereby ensuring that the forefoot region of the midsole may bend, and flex freely based on the hardness or rigidity of the midsole material in the forefoot region, and that the reinforcement member will not influence the rigidity of the forefoot area of the midsole.

In one embodiment the medial reinforcement member and/or the lateral reinforcement member may extend in an upwards direction beyond the foot facing part of the midsole, so that the reinforcement member extends in a vertical direction higher than e.g., a central part of the midsole in the vertical direction. Thus, a central part of the midsole (i.e., in a transverse region between the lateral and the medial side) may have a height that is lower than the height of the reinforcement member. The height of the reinforcement member may especially be higher than the central part of the midsole in the arch region of the sole assembly and/or midsole.

In one exemplary embodiment the reinforcement member may optionally be positioned in a forefoot region and/or a heel region, without extending into the arch region. Thus, the reinforcement member may e.g. be used to provide improved stability in the forefoot region and/or the heel region. In one exemplary embodiment, the reinforcement member may extend from the heel region to the arch region and past the arch region into the forefoot region, providing a support and increased rigidity along all three longitudinal regions of the sole assembly.

In one or more exemplary embodiments the sole assembly may comprise an outsole, the outsole having a ground facing surface and a midsole facing surface. The outsole may be positioned below the ground facing surface of the midsole, and may e.g. be adapted to provide an increased traction and/or a surface having an increased resistance to wear and tear to the midsole element. This means that the outsole comprises a ground contacting surface for the sole assembly. In one embodiment the ground facing surface of the midsole may be the ground facing surface of the sole assembly, i.e. where the ground facing surface of the midsole may be used as the ground contacting surface of the sole assembly.

In one or more exemplary embodiments the reinforcement member may have a first distal end, a heel end and a toe end, where the first distal end, the heel end and/or the toe end may abut the upper. The reinforcement member may have a body part, where the body part may connect a first distal part, a toe part and/or a heel part to each other, where the first distal end, the toe end and/or the heel end may be the terminal ends of the first distal part, the toe part and/or the heel part. The first distal part, the toe part and the heel part may be at an angle to the body part of the reinforcement member, so that the reinforcement member creates a reinforcement volume which may be capable of enclosing at least a part of the midsole. The first distal end, the heel end and/or the toe ends of the reinforcement members may be adapted to abut the outer surface of the upper, such that the body and/or the toe part, heel part and the distal part covers the outer surface of the midsole. By providing the toe part, heel part and the distal part at an angle to the body, the rigidity of the midsole may be increased, by having two or more surfaces that are angled relative to each other. The body of the reinforcement member and the toe part may have surface areas that are at a different angle to each other, where the angle may be provided in the form of a fold. The same principle may be applied between the body part and the distal part and/or the heel part. In one exemplary embodiment the heel part may be connected to the distal part and/or the toe part may be connected to the distal part. Thus, in one exemplary embodiment the toe part may be connected to the heel part via the distal part.

In one exemplary embodiment the midsole may be provided with a support element, which is positioned between the upper assembly and the reinforcement member.

In one exemplary embodiment the reinforcement member is provided on a peripheral surface of the midsole. This means that the reinforcement member is only located on an outer surface of the midsole, where the outer surface of the midsole may be positioned in a medial or lateral direction from a central axis of the sole assembly. Effectively, this means that the reinforcement member does not extend in a direction below the upper assembly of the article of footwear (in a vertical direction). Furthermore, this may mean that the lateral reinforcement member is separated from the medial reinforcement member, where the reinforcement members are connected to the midsole and not to each other.

In one exemplary embodiment the midsole may comprise a stiffness reducing portion in a region between the forefoot region and a forefoot facing part of the medial reinforcement member and/or a forefoot facing part of the lateral reinforcement member. The stiffness reducing portion may be a forefoot stiffness reducing portion.

The stiffness reducing portion may be in the form of a gap, a in a peripheral region of the sole assembly and/or the midsole, where the stiffness reducing portion may abut a toe facing part of the medial and/or lateral reinforcement member. The stiffness reducing portion may be configured to ensure that the stiffness of the arch region of the midsole is isolated from the forefoot region of the sole assembly, allowing the forefoot region to have a bending force that is lower than the region having the reinforcement member. The stiffness reducing portion may be positioned on the lateral side of the midsole and/or the medial side of the midsole. The peripheral part of the sole assembly and/or the midsole may be provided with a vertical portion, where the vertical portion abuts the upper assembly, when the sole assembly/midsole is attached to the upper assembly. The stiffness reducing portion may be in the form of a cu, void, break or a lack of material in the peripheral area of the sole assembly and/or midsole which means that a stiffness that may be in a lateral and/or medial region of the arch region of the sole assembly and/or the midsole is limited to the arch region and is unconnected to the forefoot area of the sole assembly and/or the midsole.

In one exemplary embodiment the midsole may comprise a stiffness reducing portion in a region between the heel region of the midsole and a forefoot facing part of the medial reinforcement member and/or a heel facing part of the lateral reinforcement member. The stiffness reducing portion may be a heel stiffness reducing portion.

The stiffness reducing portion may be in the form of a gap, a in a peripheral region of the sole assembly and/or the midsole, where the stiffness reducing portion may abut a heel facing part of the medial and/or lateral reinforcement member. The stiffness reducing portion may be configured to ensure that the stiffness of the arch region of the midsole and/or sole assembly is isolated from the heel region of the sole assembly, allowing the heel region to have a bending force that is lower than the arch region having the reinforcement member. The stiffness reducing portion may be positioned on the lateral side of the midsole and/or the medial side of the midsole. The peripheral part of the sole assembly and/or the midsole may be provided with a vertical portion, where the vertical portion abuts the upper assembly, when the sole assembly/midsole is attached to the upper assembly. The stiffness reducing portion may be in the form of a cu, void, break or a lack of material in the peripheral area of the sole assembly and/or midsole which means that a stiffness that may be in a lateral and/or medial region of the arch region of the sole assembly and/or the midsole is limited to the arch region and is unconnected to the heel area of the sole assembly and/or the midsole.

The forefoot and/or the heel stiffness reducing portion may be seen as an area of the sole assembly and/or midsole which ensures that the stiffness provided by the reinforcement member in the arch region of the sole assembly and/or midsole is isolated from the forefoot region and/or the heel region of the sole assembly and/or midsole, so that the rigidity of the arch region is independent of the forefoot region and/or the heel region.

In one exemplary embodiment the midsole has a first material hardness and the medial reinforcement member and/or the lateral reinforcement member have a second material hardness, where the first material hardness is different than the second material hardness. The midsole may be mechanically connected to the reinforcement member, so that the hardness of the reinforcement member may be transmitted to the midsole and/or vice versa. Thus, the provision of the midsole and the reinforcement members in different harnesses it may be possible to manipulate the rigidity of the midsole by the mechanical connection to the reinforcement member or vice versa. In an exemplary example where the reinforcement has a high rigidity (material hardness) and the midsole has a low rigidity (material hardness), the high rigidity of the reinforcement member may translate into the softer midsole, creating a joined element that has a combined rigidity that is higher than the low rigidity of the midsole. The opposite may be stated when the midsole may have a higher rigidity than the reinforcement member, where the rigidity of the midsole may be transferred to the reinforcement member.

In one exemplary embodiment the first material hardness may be lower than the second material hardness. By providing a reinforcement member that is more rigid than the midsole it may be possible to increase the stiffness of the midsole, so that the midsole element may provide a static and/or active force to the midsole and/or the side wall of the upper. Thus, when a user wears a shoe, the reinforcement member and/or midsole may abut the side of the foot (through the upper) and the reinforcement member may increase the rigidity of the midsole and/or support element to increase the static counterpressure of the midsole element. Thus, when the reinforcement member has a higher material hardness and is connected to the support element, an increased force will be required to bend the midsole element during use. This will therefore provide an increased sense of security when the user wears the article of footwear, as it will require more force to provide lateral movements of the foot relative to the sole assembly, the upper and/or the article of footwear during use. The reinforcement element may further provide an increased stiffness to the midsole, so that when a force is applied to the midsole, in an attempt to bend the midsole along its longitudinal axis, the reinforcement member will ensure that the arch region, having the reinforcement member, will require more force to bend than the forefoot region and/or the heel region.

In one or more exemplary embodiments the medial reinforcement member and/or support element and/or the lateral reinforcement member and/or lateral support element may have a first height, where the first height is higher than the height of the midsole in a central region seen in a lateral direction. This means that the reinforcement member and/or support element may extend above the central region of the midsole. Thus, a distal end of the reinforcement member and/or support element extends higher in a vertical direction than the central area of the midsole. The distal end of the reinforcement member and/or support element may be the highest point of the midsole in the central area (arch region) of the sole assembly.

In one or more exemplary embodiments the midsole in the heel region may comprise a heel support element covering at least part of the tuberosity of the calcaneus of the foot of the wearer. The heel support element may be a unitary part of the midsole of the sole assembly, where the heel support may be made of the same material as the midsole element. The heel support element may extend upwards in a vertical direction where the heel support element provides support to the heel of the user during gait. The heel support element may provide an increase rigidity to the heel part of the upper, where the heel support element covers at least part of the heel area of the upper, and may optionally be bonded to the heel area of the upper.

In one or more exemplary embodiments the medial reinforcement member and/or support element and/or the lateral reinforcement member and/or support element may have a upper vertical end, where the upper vertical end may be positioned in a region that is between 0-50% of the distance from the upper facing part of the midsole and an instep part of the upper. The instep part of the upper may be seen as the part of the upper that covers the instep of the foot, and may extend from a foot insertion opening and towards the toe end of the foot on the top surface of the upper. The peak of the instep part is approximately at a centre of the top surface of the upper, where the distance from the upper facing part of the midsole to the peak of the instep part has a predefined length for a predefined sized article of footwear. The predefined length between the peak of the instep and the upper facing part of the midsole may be defined as the instep length. Thus, within the context of the present disclosure the reinforcement member and/or support element may extend between 0-50% of the predefined length. Thus, if the predefined length between the peak of the instep and the upper facing part of the midsole is 8 cm, the height of the reinforcement member and/or support element may be between 0 and 4 cm, extending from the upper facing surface of the midsole. The reinforcement member and/or support element may more specifically extend at least 10% of the predefined length, or more specifically at least 20% of the predefined length, or more specifically at least 30% of the predefined length.

In one or more exemplary embodiments the midsole may be direct injection (DIP) moulded to the upper. Direct injection moulding is performed by inserting an upper into a footwear injection mould, where a material is injected into the mould, and the mould is closed. The material expands inside the mould and fills out all areas that are in fluid communication with the volume which the material is injected into. By using direct injection moulding it may be possible to attach the midsole and/or the sole assembly to the upper without the use of any adhesives. Thus, the midsole will be formed to the contours of the parts of the upper which the midsole is attached to. Furthermore, by utilizing direct injection moulding it is possible to attach the reinforcement member to the reinforcement member and/or support element by injecting the reinforcement member and/or support element in the volume between the reinforcement member and the upper. Thus, the material for the midsole will fill out all regions of the shoe injection mould that are accessible by the material. The reinforcement member may be inserted into the mould prior to injection, where the midsole material may be adapted to expand in such a way that the midsole material extends into an area between the upper and the reinforcement member.

The reinforcement member may have an inner surface, where the inner surface may be configured to define at least a part of the outer surface of the midsole and/or support element. Thus, the inner surface of the reinforcement member may have a shape that is identical to at least a part of the outer surface of the midsole and/or support element. Thus, the reinforcement member may define the injection cavity of the midsole and/or support element. The reinforcement member may define the entire outer surface of the support element, where the production of the support element ensures that the midsole material comes into contact with the inner surface of the reinforcement member and when the material has cured, the support element extends between the reinforcement member and the upper, where the reinforcement member is connected to the support element, which in turn is connected to the upper. Thus, the reinforcement member is connected to the upper via the support element. The support element may be seen as being a part of the midsole and fully integrated with the midsole.

In one or more exemplary embodiments the material of the midsole may be PU (Polyurethane), where the support element may be PU. In one or more exemplary embodiment the material of the medial reinforcement member and/or the lateral reinforcement member may be TPU (Thermoplastic Polyurethane). The hardness of the TPU of the reinforcement member may be higher than the hardness of the PU, where the joined support element and the reinforcement member may have a hardness that is higher than the hardness of the PU.

In one exemplary embodiment the medial reinforcement member and/or the lateral reinforcement member may have longitudinal length that is between 10% and 70% of the longitudinal length of the sole assembly or more specifically between 20 and 60% of the longitudinal length of the midsole, or more specifically between 30 and 50% of the longitudinal length of the sole assembly, or more specifically between 40 and 45% of the longitudinal length of the sole assembly. The sole assembly and the midsole may be seen as synonymous, as the midsole may have a length that extends in the same manner as the sole assembly. I.e. that the midsole and the sole assembly extends from the toe end towards the heel end of the article of footwear. The longitudinal length may be seen as the length from the toe end of the sole assembly to the heel end of the sole assembly.

A heel facing end of the reinforcement member may be positioned a distance from the heel end of the sole assembly in a longitudinal direction. A forefoot facing end of the reinforcement member may be positioned a distance from the toe end of the sole assembly in a longitudinal direction. Thus, the ends of the reinforcement member in a longitudinal direction may be spaced away from the heel end and/or the toe end of the sole assembly.

The provision of a reinforcement member that has a length that is less than the length of the sole assembly and/or the midsole means that it may be possible to increase the rigidity of a part of the sole assembly and/or the midsole using the reinforcement member. The increase in rigidity may then be limited to a part of the longitudinal length of the sole assembly, so that some parts of the sole assembly may have a rigidity that may be lower than the part of the sole assembly that has a reinforcement member. The reinforcement member may extend from a first end of the sole assembly and extend along the longitudinal length of the sole assembly towards the arch region and cover at least a part of the arch region to increase the rigidity of the midsole in the arch region, while also providing a stiffener between at least two regions of the midsole, i.e. between the heel region and the arch and the forefoot area and the arch. In a different example, the reinforcement member may extend from the heel region, across the arch region and into the forefoot region of the sole assembly.

In one exemplary embodiment the medial reinforcement member and/or the lateral reinforcement member may have a forefoot facing end which is positioned in a region which is between 20 and 40% of the longitudinal length of the outsole assembly from the toe end of the outsole assembly, or more specifically in a region which is between 25 and 35% of the longitudinal length of the outsole assembly from the toe end of the outsole assembly. Thus, the reinforcement member may terminate at a position that faces the forefoot region of the sole assembly, and where the forefoot facing end provides the terminal end of where the increase of rigidity is provided in the sole assembly. The length of the forefoot region of the sole assembly may be up to 40% of the length of the sole assembly, from the toe end towards the arch region. The forefoot facing end of the reinforcement member may e.g. define the end of the arch region of the sole assembly, where the forefoot region of the sole assembly may have a bending force that is lower than the bending force of the arch region.

In one exemplary embodiment the medial reinforcement member and/or the lateral reinforcement member may have a heel facing end which is positioned in a region which is between 10 and 50% of the longitudinal length of the outsole assembly from the heel end of the outsole assembly, or more specifically in a region which is between 20 and 40% of the longitudinal length of the outsole assembly from the heel end of the outsole assembly, or more specifically in a region which is between 25 and 35% of the longitudinal length of the outsole assembly from the heel end of the outsole assembly. Thus, the reinforcement member may terminate at a position that faces the heel region of the sole assembly, and where the heel facing end provides the terminal end of where the increase of rigidity is provided in the sole assembly. The length of the heel region of the sole assembly may be up to 50% of the length of the sole assembly, from the heel end towards the arch region. The heel facing end of the reinforcement member may e.g. define the end of the arch region of the sole assembly, where the heel region of the sole assembly may have a bending force that is lower than the bending force of the arch region. Alternatively the heel facing end may extend into the heel region of the sole assembly, where the arch region and the heel region are reinforced using the reinforcement member, so that the arch region and heel region have a similar bending force, and are of a similar stiffness from the heel region to the arch area.

In one exemplary embodiment the medial reinforcement member and/or the lateral reinforcement member may have had a first wall that extends in a vertical direction and a second wall that extends in a lateral direction. The vertical direction may be in a direction along an outer surface of the upper and/or an outer surface of the midsole. The lateral direction may be a direction that is parallel to a ground contacting surface of the sole assembly. The plane of the first wall may provide a rigidity in one direction, while the plane of the second wall may provide rigidity in a second direction. The rigidity of the reinforcement member may be seen as being at its largest in a direction that is parallel to the plane of the wall of the reinforcement member, where the wall of the reinforcement member may have a higher bending force in a direction that is parallel to the plane of the wall, while the having a lower bending force in a direction that is at an angle to the plane, such as in a direction that is normal to the plane. Thus, the first and the second wall will provide increased bending forces in their respective planes, which provides a higher combined bending force for the reinforcement member.

In one exemplary embodiment the first wall may be connected to the second wall. Thus, the first wall and the second wall may be angled relative to each other, while the walls are connected to each other along an axis that is substantially parallel to the longitudinal axis of the sole assembly. The connection and the angle of the first wall relative to the second wall may increase the rigidity of the reinforcement member, where the second wall increases the rigidity of the first wall in a direction that is normal to the plane of the first wall, and vice versa.

In one exemplary embodiment the medial reinforcement member and/or the lateral reinforcement member may define the lateral outer surface of the sole assembly, optionally in the arch region of the sole assembly. This means that the reinforcement member may define a terminal side wall of the sole assembly in a predefined region of the sole assembly, where the reinforcement member may e.g. provide a dirt and/or damage protection to a side wall of the midsole, where the midsole may be covered by the reinforcement member. The reinforcement member may define an area that may be between 2-15 cm in length and/or 1-5 cm in height, more preferably between 4-10 cm in length and 2 and 4 cm in height. The reinforcement member may extend from the heel region into the arch region of the sole assembly, or from the forefoot area and into the arch are of the sole.

In one exemplary embodiment the medial reinforcement member and/or the lateral reinforcement member may comprise a peripheral member that extends from the outer lateral surface of the medial reinforcement member and/or the lateral reinforcement member and inwards in a medial direction. (provides increased rigidity and may cover the midsole).

In one exemplary embodiment the medial support element and/or the lateral support element may have a first material hardness and the medial reinforcement member and/or the lateral reinforcement member may have a second material hardness, where the first material hardness is different than the second material hardness.

The present disclosure provides a sole assembly comprising: a midsole having a foot facing surface, a ground facing surface, a heel region, forefoot region and an arch region between the heel region and the forefoot region in a longitudinal direction, a medial reinforcement member positioned at a medial side of the midsole and/or a lateral reinforcement member positioned at a lateral side of the midsole, where the medial and/or the lateral reinforcement member is/are configured to increase the rigidity of the midsole in a longitudinal direction in the arch region.

In one embodiment, a distal surface (upper surface) of the midsole and/or the reinforcement member may be provided with a fixation member. The fixation member may be utilized to attach laces or a tensioning device which is adapted to extend across the instep of the user, from a medial support element or reinforcement member to a distal support element or reinforcement member. Thus, the fixation member device may be adapted to provide mechanical connection to the midsole via the support element and/or the reinforcement member.

In one or more exemplary embodiments the medial support element and/or the lateral support element may extend from the foot facing surface in a vertical direction. The support element may extend upwards from the midsole, where the support element may raise the height of the midsole in the arch area of the sole assembly. The support element may raise upwards to support the sides of the foot, where the support element may be attached to an outer side of the upper and provide support to the foot of the user during use. The support element may extend vertically upwards.

In one or more exemplary embodiments the medial support element and/or the lateral support element may extend from the foot facing surface in a medial direction. By having the support element extend inwards in a medial direction, the support element may extend inwardly towards a vertical plane that extends along the longitudinal axis of the article of footwear. The medial extension may mean that the support element may follow the shape of the upper and/or the foot of the user, where the foot of the user curves in the medial direction from the sole towards the instep of the foot. The inwards extension of the support element may be adapted to follow the shape of the foot to provide a support in a lateral and/or medial side of the foot in the arch area. I.e. on the side of the foot between the heel and the forefoot area.

In one embodiment the support element may have a curvature that follows the curvature of the outer surface of the upper and/or the outer surface of the foot of the user in an arch region of the article of footwear.

In one or more exemplary embodiments the medial support element and/or the lateral support element may abut the outer surface of the upper. This means that the support element may provide mechanical strength to the upper of the article of footwear. Thus, the provision of the support element may mean that a mechanical strengthening of the upper may not be necessary, as the support element of the midsole provides mechanical strengthening to the side of the upper. Thus, it may not be necessary to provide a strengthening element in order to improve the tensional strength of the upper in the area where e.g. a lacing system is tensioned to achieve support to the side of the foot. The upper of a shoe is adapted to fit the foot of the user, and by having a support element that abuts the upper, the support element provides support to the side of the foot during use. The support element may be configured to increase the resistance in the area where the support element is provided, thereby reducing the tendency of the upper to be forced outwards in a lateral direction as the support element increases provides a counterforce to the side of the upper.

In one or more exemplary embodiments the support element may bond the reinforcement member to the outer surface of the upper. The present disclosure is configured for attaching the reinforcement member to the support element where the support element is bonded on the side which faces the reinforcement member to the reinforcement member. The support element may bond on the opposite side to the upper, so that the reinforcement member is bonded via the support element to the upper. This is particularly when the support element expands into a volume between the upper and the reinforcement member, where the curing of the support element provides a bond between the two surfaces. Thus, the material for the midsole may fill out all regions of the shoe injection mould that are accessible by the material. The reinforcement member may be inserted into the mould prior to injection, where the midsole material may be adapted to expand in such a way that the midsole material extends into an area between the upper and the reinforcement member and bonds the reinforcement member to the upper.

In one or more exemplary embodiments the support element may bond the reinforcement member to the sole assembly. The present disclosure is configured for attaching the reinforcement member to the support element where the support element is bonded on the side which faces the reinforcement member to the reinforcement member. The support element extends from the midsole and ensures that the reinforcement member is attached to the midsole and thereby the sole assembly. This is particularly when the support element expands into a volume defined by the reinforcement member and comes into contact with an inner surface of the reinforcement member.

In one or more exemplary embodiments the medial reinforcement member and/or the lateral reinforcement member may enclose at least part of the lateral surface of the medial support element and/or the lateral support element, respectively, wherein the medial reinforcement member and/or the lateral reinforcement member may optionally enclose the entire lateral surface of the medial support element and/or the lateral support element, respectively. Thus, the reinforcement member may be adapted to cover an outer surface of the support element, where the outermost surface of the sole assembly may be defined by the reinforcement member. Thus, the reinforcement member may e.g. be adapted to protect the material of the support element from wear and tear, as well as from discoloration and/or deterioration. In one example, the reinforcement member may enclose the entire outer surface of the support element, so that the support element may not be visible from the outside of the article of footwear.

In one or more exemplary embodiments the medial support element and/or the lateral support element may extend from ground facing surface of the midsole in a vertical direction Thus, the support element may extend from the ground facing surface of the midsole and upwards, thereby extending the height of the midsole in the area of the support element. The support element may extend from the ground facing surface and extend upwards towards a distal end, where the distal end extends beyond the top surface (upper facing surface) of the midsole. Thus, the distal end of the support element may be the top part of the midsole and/or sole assembly in the arch area of the sole assembly.

In one embodiment, the distal surface of the support element and/or the reinforcement member may be provided with a fixation member. The fixation member may be utilized to attach laces or a tensioning device which is adapted to extend across the instep of the user, from a medial support element or reinforcement member to a distal support element or reinforcement member. Thus, the fixation member device may be adapted to provide mechanical connection to the midsole via the support element and/or the reinforcement member.

In one or more exemplary embodiments a part of the medial support element and/or the lateral support element may have a height in a vertical direction that is at least 150% of the height of the midsole in a central area defined in a lateral direction, or more preferably a height in a vertical direction that may be at least 180% of the height of the midsole in a central area defined in a lateral direction, or more preferably a height in a vertical direction that is at least 200% of the height of the midsole in a central area defined in a lateral direction, or more preferably a height in a vertical direction that is at least 230% of the height of the midsole in a central area defined in a lateral direction. The height may be defined as being the length from the ground facing surface and upwards in a vertical direction.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

BRIEF DESCRIPTION OF THE DRAWINGS

The following is an explanation of exemplary embodiments with reference to the drawings, in which.

DETAILED DESCRIPTION

Figure 1:
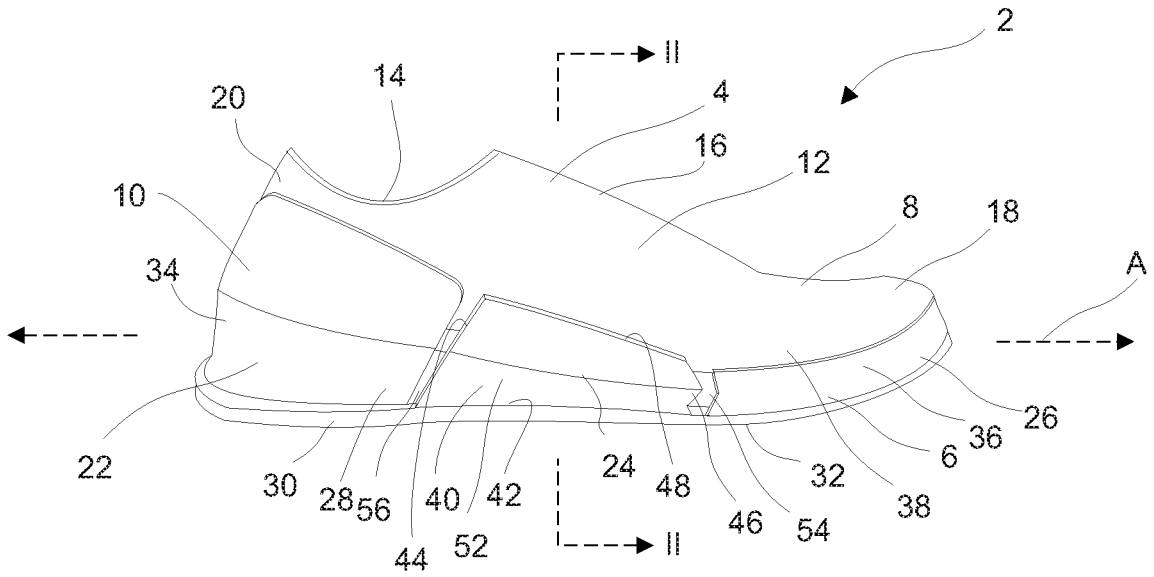
FIG. 1 shows a side view of an exemplary article of footwear.

FIG. 1 shows a side view of an exemplary article of footwear 2, where the article of footwear comprises an upper 4 and a sole assembly 6. The article of footwear may be seen as having a forefoot region 8, a heel region 10 and an arch region 12, where the forefoot region may be seen as a region to accommodate the forefoot of the user, the heel region 10 as the region to accommodate a heel of a user and where the arch region 12 may be seen as a region which accommodates the arch as well as the instep of the user during use. The regions 8, 10, 12 may be seen as separate parts of the article of footwear, in a direction parallel to a longitudinal axis A of the article of footwear, where each region may be seen as having a specific purpose, where the forefoot region 8 may be seen as a flexible area of the footwear, allowing the sole assembly 6 to flex with the foot of the user. The heel region 10 may be seen as the part which provides the initial shock absorption during gait, while the arch region 12 may be seen as a part of the article of footwear 2 which provides the user with support, both to the arch region of the foot, as well as the instep during use.

The upper 4 comprises a heel end 20, a foot insertion opening 14, an instep portion 16, a toe end 18, where the upper 4 may be permanently connected to the sole assembly 6 from the toe end 18 towards the heel end 20 at a ground facing surface (not shown) of the upper 4.

The sole assembly 6 comprises a heel region 22, an arch region 24 and a forefoot region 26, where the arch region 24 is positioned between the heel region 22 and the forefoot region 26 in a direction along the longitudinal axis A. The sole assembly may comprise a midsole 28 which may provide shock absorption as well as an outsole 30 which may provide a ground contacting surface 32. In this exemplary embodiment, the heel region 22 of the sole assembly 6 comprises a heel cap 34, which may provide support to the heel of the user during use, where the heel cap 34 may be unitary with the midsole 28 and may be made of the same material as the midsole 28. The forefoot region 26 may comprise a peripheral part 36, which abuts and is bonded to the outer surface 38 of the upper 4.

The arch region 24 of the sole assembly 6 may comprise a medial support member 40, where the medial support member 40 extends from a ground facing surface 42 of the midsole 28 and upwards along the outer surface 38 of the upper and extends a predefined distance along the surface 38 of the upper 4 in a direction towards the instep portion 16 of the upper 4. The support member 40 may be limited to the arch region of the article of footwear, i.e. where the support member 40 does not extend towards the last 25% of the length of the sole assembly in a longitudinal direction, and/or does not extend into the forward 25% of the length of the sole assembly in a longitudinal direction. Thus, the support member may be outside the heel region 22 and/or the forefoot region 26.

The support member 40 may have a heel end 44 and a toe end 46, as well as a distal end 48, where the support member 40 may have a larger height at the heel end 44 than the toe end 46, where the support member 40 may optionally gradually decrease in height from the heel end 44 towards the toe end 46.

Figure 2:
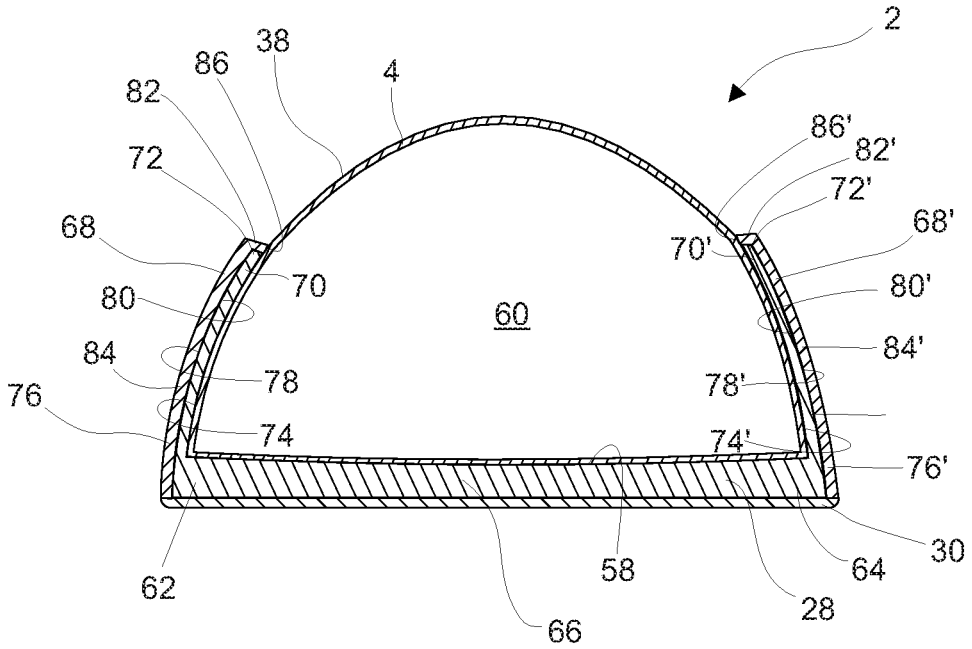
FIG. 2 shows a sectional view of an arch region of an exemplary article of footwear taken along the line II-II.

The support member 40 may comprise a support element 50 (not shown) and a reinforcement member 52, where the support element is part of the midsole 28 of the sole assembly, while the reinforcement member 52 may be a separate element that may be bonded to the support element, as shown in FIG. 2.

The sole assembly 6 may comprise a first flex zone 54, which extends between the forefoot region 26 and the arch region 24, and/or a second flex zone 56 which extends between the heel region 22 and the arch region 24. The first flex zone 54 may be adapted to provide an area of increased or decreased flex between the arch region 24 and the forefoot region 26. The second flex zone 56 may be adapted to provide an area of increased or decreased flex between the arch region 24 and the heel region 22. Thus, in an example, the second flex zone may be adapted to provide decreased flex between the heel region 22 and the arch region 24, which may mean that the arch region 24 and the heel region may have a somewhat uniform flexibility along its length. In one example, the first flex zone 54 may have decreased flexibility, allowing the forefoot region 26 to flex somewhat independently from the arch region 24, i.e. where the forefoot may be capable of flexing or bending at a lower force than e.g. the arch region.

The support element shown in the Figs. may be of any kind or size, and may be an integrated part of the midsole, and within the scope of the invention, the support element may also be considered as an outer part of the midsole.

FIG. 2 shows a sectional view of the article of footwear 2 taken along the line II-II of FIG. 1. The upper 4 extends from the foot facing surface 58 of the midsole 28, and defines a part of the foot insertion volume 60 of the article of footwear 2. The midsole 28 has a medial side 62 and a lateral side 64, as well as a central area 66.

The sole assembly 6 may comprise a medial support member 68 (similar to the support member 40 in FIG. 1), where the medial support member comprises a support element 70 which is a unitary part of the medial side 62 of the midsole 28, and extends in an upwards direction from the foot facing surface 58 and terminates in a distal end 72. The support element 70 may be bonded to the outer surface 38 of the upper, providing support to the medial side 74 of the upper 4, and thereby provide support to the foot when it is inside the foot insertion volume 60. The medial support member 68 may further comprise a reinforcement member 76, where the reinforcement member 76 abuts the outer surface 78 of the support element 70, and is bonded to the midsole 28 as well as the support element 70 of the sole assembly 6. The reinforcement member 76 may have an inner surface 80 that is connected to the support element 70 along its vertical length, as well as along its longitudinal length (along longitudinal axis A). The reinforcement member 76 may have a distal part 82, which is at an angle from a body part 84 of the reinforcement member, and terminates in a distal periphery 86 which may abut the outer surface 38 of the upper 4. The reinforcement member 76 may be attached to the midsole 28 via the support element 70, where during manufacturing the support element 70 via direct injection moulding, the support element fills out volume between the reinforcement member 76 and the upper 4, and upon curing attaches the reinforcement member to the upper 4.

The sole assembly 6 may comprise a lateral support member 68' (similar to the support member 40 in FIG. 1), where the lateral support member comprises a support element 70' which is a unitary part of the lateral side 62' of the midsole 28, and extends in an upwards direction from the foot facing surface 58 and terminates in a distal end 72'. The support element 70' may be bonded to the outer surface 38 of the upper, providing support to the lateral side 74' of the upper 4, and thereby provide support to the foot when it is inside the foot insertion volume 60. The lateral support member 68' may further comprise a reinforcement member 76', where the reinforcement member 76' abuts the outer surface 78 of the support element 70', and is bonded to the midsole 28 as well as the support element 70' of the sole assembly 6. The reinforcement member 76' may have an inner surface 80' that is connected to the support element 70' along its vertical length, as well as along its longitudinal length (along longitudinal axis A). The reinforcement member 76' may have a distal part 82', which is at an angle from a body part 84' of the reinforcement member, and terminates in a distal periphery 86' which may abut the outer surface 38 of the upper 4. The reinforcement member 76' may be attached to the midsole 28 via the support element 70', where during manufacturing the support element 70' via direct injection moulding, the support element fills out volume between the reinforcement member 76' and the upper 4, and upon curing attaches the reinforcement member to the upper 4.

The support member 68 may be adapted to provide increase rigidity in a lateral direction, and may be adapted to provide support to the side of the foot of the user during use.

Figure 3:
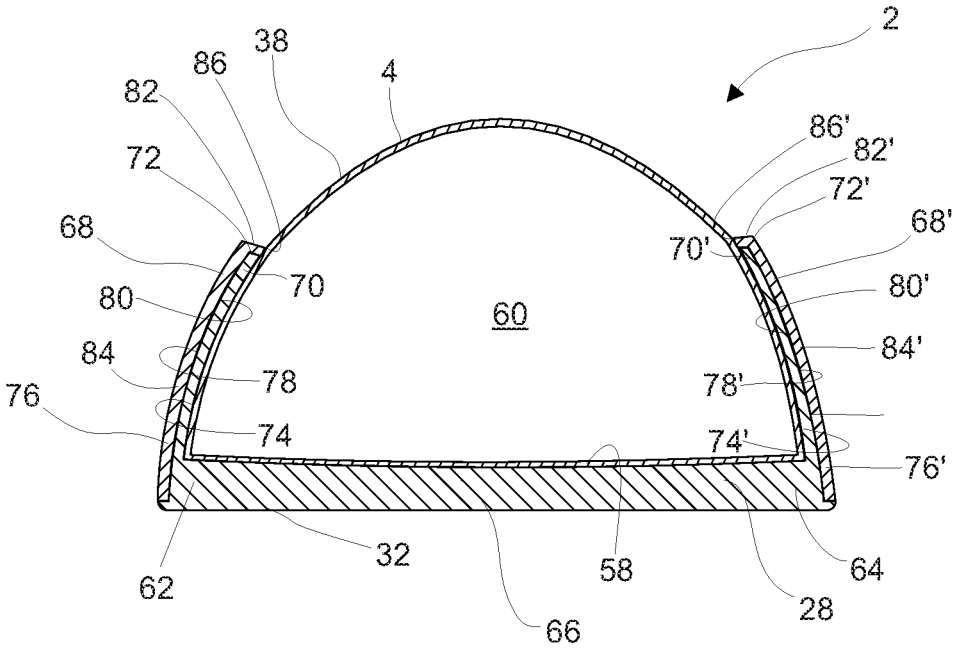
FIG. 3 shows a sectional view of an arch region of an exemplary article of footwear taken along the line II-II.

FIG. 3 shows a similar article of footwear 2 to that shown in FIG. 2, with the exception that the midsole 38 defines the ground contacting surface. The description related to FIG. 2 may be applied similarly in FIG. 3.

Figure 4:
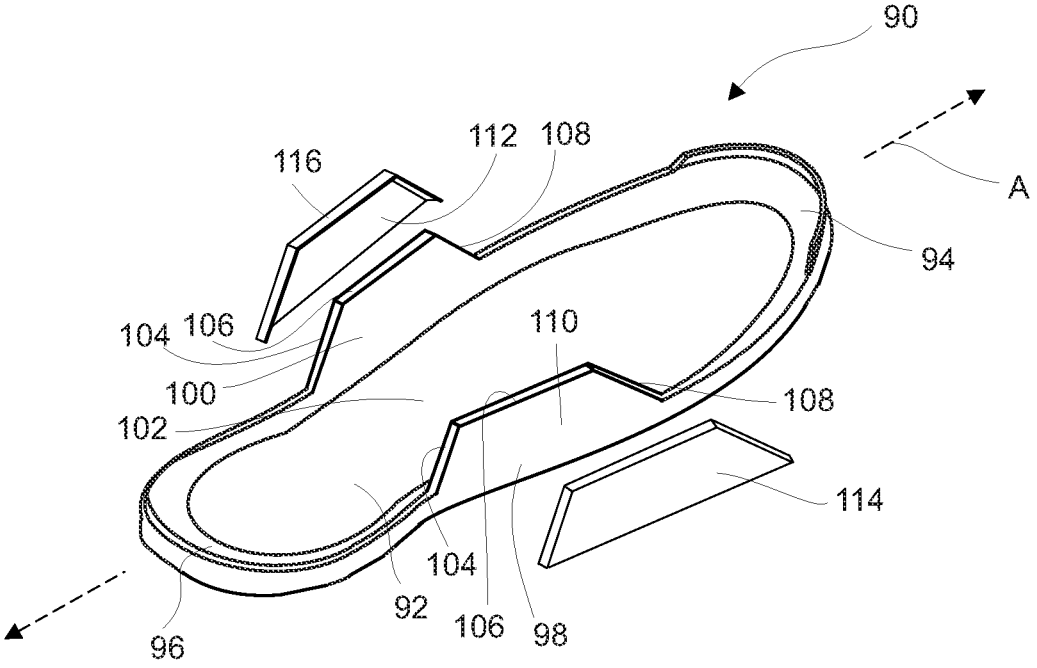
FIG. 4 shows a perspective exploded view of an exemplary sole assembly.

FIG. 4 shows an exploded view of a sole assembly 90 in accordance with the present disclosure, where the sole assembly 90 comprises a midsole 92, which extends from a toe end 94 to a heel end 96 along a longitudinal axis A of the sole assembly. The midsole 92 comprises a medial support element 98 and a lateral support element 100 which are positioned at the peripheral boundary of the arch area 102 of the sole assembly 90. The midsole 92 may be direct injection moulded to an upper (not shown) inside a shoe mold assembly, where the midsole is defined by an empty volume, to which an expanding material may fill up and when the material is cured the midsole will take the shape of the empty volume of the mould. The support element 98 and 100 may comprise a heel end 104, a distal end 106 and a toe end 108, as well as a medial surface 110, where the shape of the support element may be defined by an inner surface 112 of a medial reinforcement member 114 and a lateral reinforcement member 116, respectively. The reinforcement members 112, 114 may be prefabricated, and inserted into a predefined part of a shoe mold, so that the reinforcement members 112, 114 define the shape of the support elements 98, 100, respectively, where the toe end, distal end and heel end are defined by corresponding inner surfaces on the reinforcement members.

Figure 5:
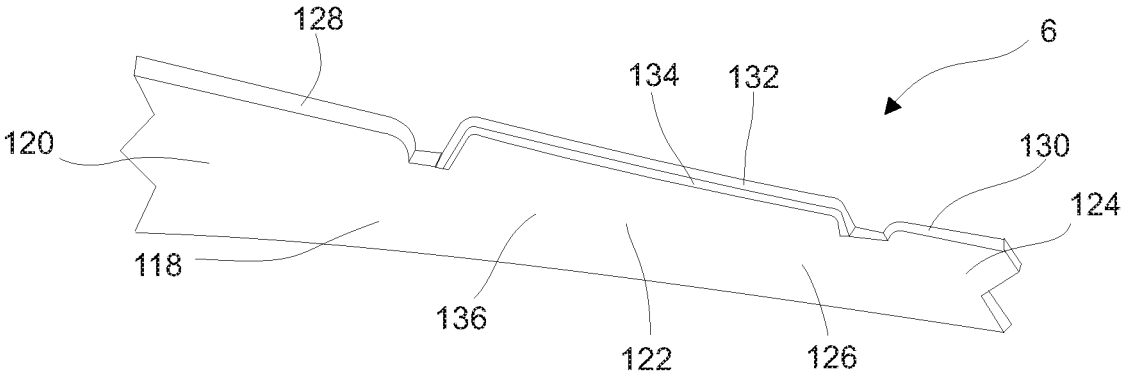
FIG. 5 shows a perspective view of an inner side of a part of an exemplary sole assembly.

FIG. 5 shows an exemplary part of a side periphery 118 of a sole assembly 6 in accordance with the present disclosure, where the side periphery 118 comprises a heel region 120, an arch region 122 and a forefoot region 124. The side periphery 118 may be unitary or integral with the midsole of the sole assembly 6, where the inner surface 126 is configured to bond to an upper (not shown) of an article of footwear. The upper edge 128 of the heel region 120 and the upper edge 130 of the forefoot region may be defined by the shape of a shoe injection mould (not shown) which is clamped to an upper which has been mounted on a last. However, as may be seen, the sole assembly 6 comprises a reinforcement member 132, which has an inner edge 134, where the inner edge 134 is adapted to be in contact with the lasted upper, and where the inner edge and a volume defined by the reinforcement member defines the outer shape of a support element 136, where the support element 136 attaches the reinforcement member 132 to the upper. The reinforcement member 132 may have a higher stiffness than the support element, which means that the arch region 122 of the sole assembly 6 is stiffer than the forefoot region 124 and the heel region 120.

Figure 6:
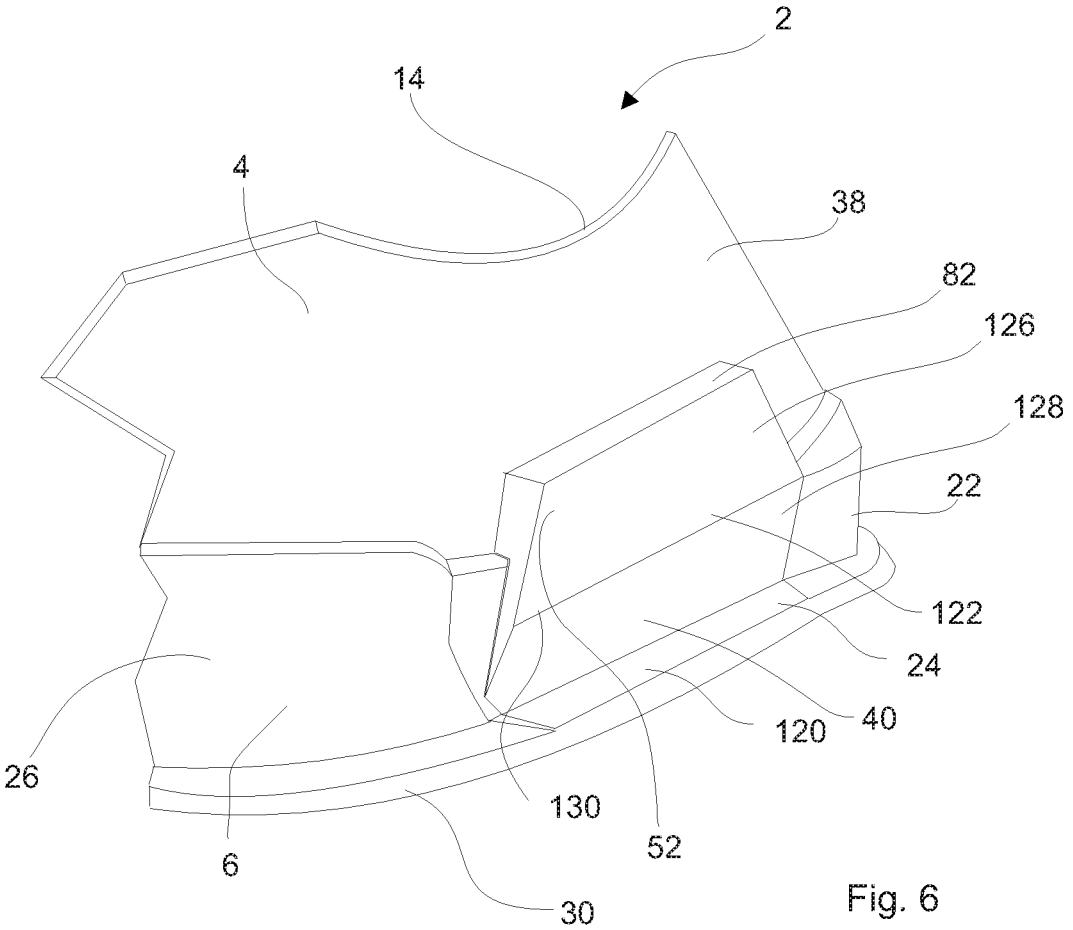
FIG. 6 shows a perspective view of a part of an outer side of an exemplary article of footwear.

FIG. 6 shows a perspective view of a part of an outer side of an exemplary article of footwear 2, having an upper 4 and a sole assembly 6. The reference numbers used in FIG. 6 are the same as shown in FIG. 1 and/or FIG. 2, and the elements shown in FIG. 1 or 2 may also be seen in FIG. 6 even though they are not explicitly named in the following. The sole assembly 6 comprises a heel region 22, an arch region 24 and a forefoot region 26, where the arch region 24 is positioned between the heel region 22 and the forefoot region 26 in a direction along the longitudinal axis A. The sole assembly 6 comprises a support member 40 in the arch region 24, where the support member 40 comprises a reinforcement member 52 and a support element 70 (which cannot be seen) as the reinforcement member 52 covers the entire support element, so that the support element cannot be seen from the outside, but is positioned between the inner surface of the reinforcement member and the outer surface 38 of the upper 4. The reinforcement member 52 may extend from an upper surface 40 of the outsole 30 towards its distal end 82.

Figure 7:
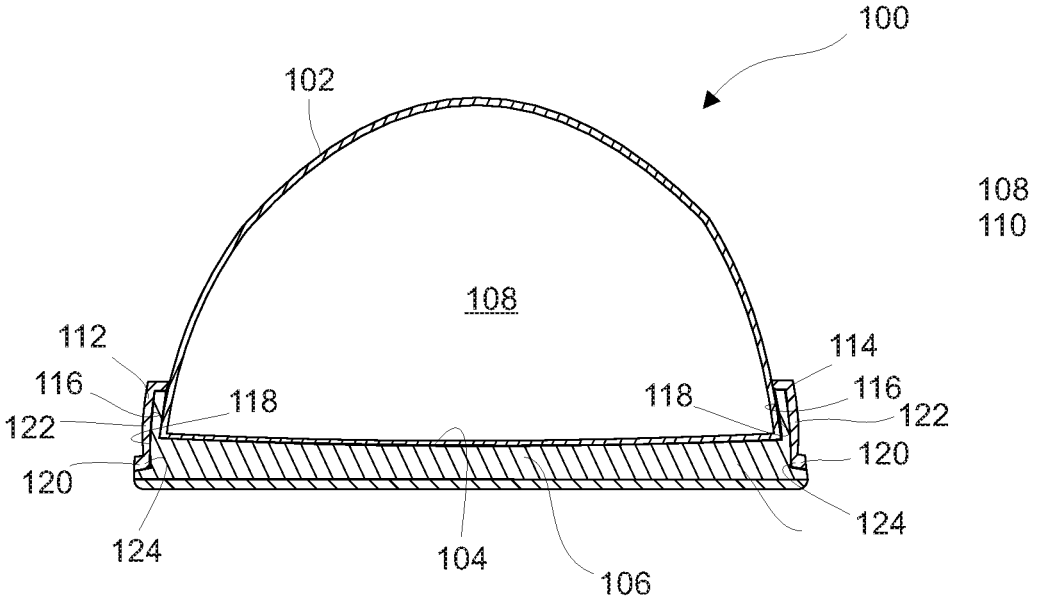
FIG. 7 shows a sectional view of an arch region of an exemplary article of footwear.

FIG. 7 shows a sectional view of an arch region of an exemplary article of footwear 100, where the upper 102 extends from the foot facing surface 104 of the midsole 106 and defines a part of the foot insertion volume 108 of the article of footwear 100.

The sole assembly 110 may comprise a medial reinforcement member 112 and a lateral reinforcement member 114, which has an inner surface 116 which may be bonded to the outer medial and/or lateral surface 118 of the midsole 106. The reinforcement members 112 and 114 may comprise a first wall 120 and a second wall 122, where the first wall 120 provides an increased rigidity in a horizontal direction, while the second wall 122 provides an increased rigidity in a vertical direction. The two walls may be connected to each other via a connecting part 124, which allows the rigidity of one wall to be translated to the second wall, creating a reinforcement member 112, 114 that has rigidity in at least two directions. This may also be seen in FIG. 6.

The second wall 122 shown in FIG. 6 may further comprise an upper wall 126 and a lower wall 128, which may be angled with respect to each other via a middle part 130, so that the second wall may provide reinforcement in two directions that are not parallel to each other, where both directions are different from the direction of the first wall 120.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering.

Furthermore, the labelling of a first element does not imply the presence of a second element and vice versa.

It is to be noted that the word "comprising" does not necessarily exclude the presence of other elements or steps than those listed.

It is to be noted that the words "a" or "an" preceding an element do not exclude the presence of a plurality of such elements.

It should further be noted that any reference signs do not limit the scope of the claims, that the exemplary embodiments may be implemented at least in part by means of both hardware and software, and that several "means", "units" or "devices" may be represented by the same item of hardware.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly, to be regarded in an illustrative rather than restrictive sense. The claimed invention is intended to cover all alternatives, modifications, and equivalents.

The invention claimed is:

1. An article of footwear, comprising:

an upper having an outer surface, a foot insertion volume, and a sole facing surface; and a sole assembly comprising:

a midsole having a foot facing surface, a ground facing surface, a heel region, a forefoot region, and an arch region, the arch region being positioned between the heel region and the forefoot region in a longitudinal direction, and a medial reinforcement member positioned at a medial side of the midsole or a lateral reinforcement member positioned at a lateral side of the midsole, where the medial reinforcement member or the lateral reinforcement member is configured to increase rigidity of the midsole in a longitudinal direction in the arch region, wherein the medial reinforcement member or the lateral reinforcement member extends at least in a region between 40% of a longitudinal length of the sole assembly from a toe end of the sole assembly and 40% of the longitudinal length of the sole assembly from a heel end of the sole assembly, and wherein the upper is configured to connect a part of a medial side of the sole assembly to a part of a lateral side of the sole assembly by a part of the upper positioned above the foot insertion volume.

2. The article of footwear according to claim 1, wherein the sole assembly comprises an outsole, the outsole having a ground facing surface and a midsole facing surface.

3. The article of footwear according to claim 1, wherein the midsole comprises a stiffness reducing portion in a region between the forefoot region and a forefoot facing part of the medial reinforcement member or a forefoot facing part of the lateral reinforcement member.

4. The article of footwear according to claim 1, wherein the midsole comprises a stiffness reducing portion in a region between the heel region of the midsole and a forefoot facing part of the medial reinforcement member or a heel facing part of the lateral reinforcement member.

5. The article of footwear according to claim 1, wherein the midsole has a first material hardness and the medial reinforcement member or the lateral reinforcement member have a second material hardness, where the first material hardness is different than the second material hardness.

6. The article of footwear according to claim 5, where the first material hardness is lower than the second material hardness.

7. The article of according to claim 1, wherein the medial reinforcement member or the lateral reinforcement member have a longitudinal length that is between 10% and 70% of the longitudinal length of the sole assembly.

8. The article of footwear according to claim 1, wherein the medial reinforcement member or the lateral reinforcement member have a forefoot facing end which is positioned in a region which is between 20 and 40% of the longitudinal length of the sole assembly from the toe end of the sole assembly.

9. The article of footwear according to claim 1, wherein the medial reinforcement member or the lateral reinforcement member have a heel facing end which is positioned in a region which is between 10% and 50% of the longitudinal length of the sole assembly from the heel end of the sole assembly.

10. The article of footwear according to claim 1, wherein the part of the upper positioned above the foot insertion volume and configured to connect the part of the medial side of the sole assembly to the part of the lateral side of the sole assembly includes a strap.

11. The article of footwear according to claim 1, wherein the part of the upper positioned above the foot insertion volume and configured to connect the part of the medial side of the sole assembly to the part of the lateral side of the sole assembly includes a lace for connecting opposing parts of the upper.

12. The article of footwear according to claim 1, wherein the medial reinforcement member or the lateral reinforcement member defines the lateral outer surface of the sole assembly.

13. The article of footwear according to claim 1, wherein the medial reinforcement member or the lateral reinforcement member comprises a peripheral member that extends from the outer lateral surface of the medial reinforcement member or the lateral reinforcement member and inwards in a medial direction.

14. The article of footwear according to claim 1, further comprising a medial support element or a lateral support element, wherein the medial support element or the lateral support element have a first material hardness and the medial reinforcement member or the lateral reinforcement member have a second material hardness, where the first material hardness is different than the second material hardness.

15. A sole assembly comprising:

a midsole having a foot facing surface, a ground facing surface, a heel region, a forefoot region, and an arch region between the heel region and the forefoot region in a longitudinal direction, and a medial reinforcement member positioned at a medial side of the midsole or a lateral reinforcement member positioned at a lateral side of the midsole, where the medial reinforcement member or the lateral reinforcement member is configured to increase rigidity of the midsole in a longitudinal direction in the arch region, wherein the medial reinforcement member or the lateral reinforcement member extends at least in a region between 40% of a longitudinal length of the sole assembly from a toe end of the sole assembly and 40% of the longitudinal length of the sole assembly from a heel end of the sole assembly.

16. An article of footwear, comprising:

an upper having an outer surface, a foot insertion volume, and a sole facing surface; and a sole assembly comprising:

a midsole having a foot facing surface, a ground facing surface, a heel region, a forefoot region, and an arch region, the arch region being positioned between the heel region and the forefoot region in a longitudinal direction, and a medial reinforcement member positioned at a medial side of the midsole and a lateral reinforcement member positioned at a lateral side of the midsole, where one or more of the medial reinforcement member and the lateral reinforcement member is configured to increase rigidity of the midsole in a longitudinal direction in the arch region, wherein the medial reinforcement member or the lateral reinforcement member extends at least in a region between 40% of a longitudinal length of the sole assembly from a toe end of the sole assembly and 40% of the longitudinal length of the sole assembly from a heel end of the sole assembly, and wherein the upper is configured to connect at least a part of a medial side of the sole assembly to at least a part of a lateral side of the sole assembly by at least a part of the upper positioned above the foot insertion volume.

17. The article of footwear according to claim 16, wherein the midsole comprises a stiffness reducing portion in a region between the forefoot region and a forefoot facing part of the medial reinforcement member and a forefoot facing part of the lateral reinforcement member.

18. The article of footwear according to claim 16, wherein one or more of the medial reinforcement member and the lateral reinforcement member have a heel facing end which is positioned in a region which is between 10% and 50% of the longitudinal length of the sole assembly from the heel end of the sole assembly.

19. The article of footwear according to claim 16, wherein one or more of the medial reinforcement member and the lateral reinforcement member have a longitudinal length that is between 20% and 60% of the longitudinal length of the sole assembly.

20. The article of footwear according to claim 16, wherein the medial reinforcement member and the lateral reinforcement member define the lateral outer surface of the sole assembly.

* * * * *